US010422345B2

(12) United States Patent
Parker et al.

(10) Patent No.: US 10,422,345 B2
(45) Date of Patent: Sep. 24, 2019

(54) CENTRIFUGAL COMPRESSOR CURVED DIFFUSING PASSAGE PORTION

(71) Applicant: General Electric Company, Schenectady, NY (US)

(72) Inventors: David Vickery Parker, Middleton, MA (US); Michael Macrorie, Winchester, MA (US); Caitlin Jeanne Smythe, Cambridge, MA (US); David Paul Miller, North Andover, MA (US)

(73) Assignee: General Electric Company, Schenectady, NY (US)

( * ) Notice: Subject to any disclaimer, the term of this patent is extended or adjusted under 35 U.S.C. 154(b) by 177 days.

(21) Appl. No.: 15/101,633

(22) PCT Filed: Oct. 17, 2014

(86) PCT No.: PCT/US2014/061020
§ 371 (c)(1),
(2) Date: Jun. 3, 2016

(87) PCT Pub. No.: WO2015/102727
PCT Pub. Date: Jul. 9, 2015

(65) Prior Publication Data

US 2018/0328381 A1 Nov. 15, 2018

(51) Int. Cl.
*F04D 29/44* (2006.01)
*F01D 9/02* (2006.01)
*F04D 17/10* (2006.01)

(52) U.S. Cl.
CPC ..... *F04D 29/444* (2013.01); *F01D 9/02* (2013.01); *F04D 17/10* (2013.01);
(Continued)

(58) Field of Classification Search
CPC ..... F04D 29/444; F04D 17/10; F02C 3/08; F01D 9/02; F05D 2240/128; F05D 2220/32; F05D 2250/324
See application file for complete search history.

(56) References Cited

U.S. PATENT DOCUMENTS 3,333,762 A * 8/1967 Vrana ..... F04D 21/00 415/207
3,876,328 A 4/1975 Exley
(Continued)

FOREIGN PATENT DOCUMENTS

| | | |
|---|---|---|
| CN | 101368512 A | 2/2009 |
| GB | 920260 A | 3/1963 |
| GB | 2150638 A | 7/1985 |

OTHER PUBLICATIONS

Machine Translation and Fist Office Action and Search issued in connection with corresponding CN Application No. 201480066664.6 dated Jun. 26, 2017.

(Continued)

*Primary Examiner* — Eldon T Brockman
(74) *Attorney, Agent, or Firm* — Dority & Manning, P.A.

(57) ABSTRACT

A diffuser for a centrifugal compressor including an annular diffuser housing having a plurality of diffuser flow passages therethrough the housing. Each passage including a throat portion and a diffusing section with upstream and downstream diffusing portions. A diffusing passage centerline includes a linear portion extending downstream through the throat portion and the upstream diffusing portion and a curved portion of the diffusing passage centerline extending downstream from the centerline linear portion through the downstream diffusing portion. The diffuser flow passages may have an equivalent cone angle varying non-linearly or
(Continued)

more particularly curvilinearly downstream along curved portion. The downstream diffusing portion may be flared.

24 Claims, 5 Drawing Sheets

(52) U.S. Cl.
CPC .... *F05D 2220/32* (2013.01); *F05D 2240/128* (2013.01); *F05D 2250/324* (2013.01)

(56) References Cited

U.S. PATENT DOCUMENTS 3,964,837 A * 6/1976 Exley ..... F04D 29/441 415/181
4,027,997 A 6/1977 Bryans
4,576,550 A 3/1986 Bryans
5,266,002 A * 11/1993 Brasz ..... F04D 29/444 415/208.3
5,445,496 A * 8/1995 Brasz ..... F04D 29/444 415/208.3
6,540,481 B2 * 4/2003 Moussa ..... F01D 5/145 415/208.2
8,038,392 B2 * 10/2011 Honda ..... F04D 29/441 415/208.3
2002/0146320 A1 10/2002 Moussa
2009/0304502 A1 * 12/2009 Nolcheff ..... F01D 9/041 415/208.2

OTHER PUBLICATIONS

International Search Report and Written Opinion issued in connection with corresponding PCT application PCT/US2014/061020 dated Jun. 24, 2015.

* cited by examiner

CENTRIFUGAL COMPRESSOR CURVED DIFFUSING PASSAGE PORTION

GOVERNMENT INTERESTS

Embodiments of the present invention were made with government support under government contract No. W911W6-11-2-0009 by the Department of Defense. The government has certain rights to embodiments of the present invention.

TECHNICAL FIELD

Embodiments of the present invention relate to diffuser passages for gas turbine engine centrifugal compressors.

BACKGROUND

A gas turbine engine centrifugal compressor includes a rotating impeller arranged to accelerate and, thereby, increase the kinetic energy of air flowing therethrough. A diffuser is generally located immediately downstream of and surrounding the impeller. The diffuser operates to decrease the velocity of the air flow leaving the impeller and transform the energy thereof to an increase in static pressure, thus, pressurizing the air.

Diffusers have generally included a plurality of circumferentially spaced passages which converge to an annular space surrounding the impeller. These passages expand in area downstream of the impeller in order to diffuse the flow exiting the impeller. One such diffuser is disclosed in U.S. Pat. No. 4,027,997 issued to A. C. Bryans on Jun. 7, 1977, and assigned to the assignee of this patent. The diffuser passages in this patent assume an initial circular cross section so as to accommodate with minimal losses the relatively high-flow velocities of the air exiting the impeller and, thereafter, gradually merge into a near-rectangular outlet to minimize losses. Each passage gradually merges from a circular cross section at a throat portion near its inlet end, to a near rectangular cross section at its outlet end defined by two flat opposing parallel sides and two flat opposing curved sides which produce a razor sharp trailing edge at the diffuser outlet. This near rectangular shape of the diffuser outlet optimizes the flow distribution to an annular combustion chamber in flow communication with the diffuser outlet.

A diffuser in U.S. Pat. No. 4,576,550 issued to A. C. Bryans on Mar. 18, 1986, and assigned to the assignee of this patent discloses each of the passages includes a throat portion having a quadrilateral cross section, including two substantially parallel linear sidewalls and two substantially arcuate opposing sidewalls, effective for reducing the length of and, thereby, pressure losses from the annular inlet. The linearity and regularity of the diffuser passages enables the diffuser to be manufactured to close tolerances by electric discharge milling an annular plate utilizing a single tool. This assures uniformity and consistency between diffusers. U.S. Pat. No. 4,576,550 is incorporated herein by reference.

We have found that these diffuser designs either reduce trailing edge blockage with greater than optimum area ratios or with large trailing edge blockages that impair performance of downstream components that remove swirl before flow enters the combustor.

Thus, there continues to be a demand for advancements in diffuser design and geometry that improves aerodynamic performance and reduces the overall engine radial envelope.

BRIEF DESCRIPTION OF THE INVENTION

A diffuser for a centrifugal compressor includes an annular diffuser housing and a plurality of diffuser flow passages extending through the housing and spaced about a circumference of the housing. Each of the passages includes a throat portion and a diffusing section downstream of the throat portion. The diffusing section includes upstream and downstream diffusing portions. Each of the passages further includes a diffusing passage centerline having a centerline linear portion extending downstream through the throat portion and the upstream diffusing portion of each of the diffuser flow passages and a curved portion of the diffusing passage centerline extending downstream from the centerline linear portion through the downstream diffusing portion.

Adjacent ones of the passages may intersect with each other at radially inner inlet portions of the passages and define a quasi-vaneless annular inlet of the diffuser. Each of the passages may include the throat portion downstream of and integral with one of the inlet portions and the centerline linear portion extending downstream through the inlet portion and the throat portion.

Each of the diffuser flow passages may have an equivalent cone angle varying non-linearly downstream along the curved portion of the diffusing passage centerline through the downstream diffusing portion of the diffuser flow passage. The equivalent cone angle may vary curvedly or curvilinearly downstream along the curved portion of the diffusing passage centerline through the downstream diffusing portion of the diffuser flow passage.

The downstream diffusing portion of each of the diffuser flow passages may include axially spaced apart flat forward facing and aft facing or forward and aft sides.

The downstream diffusing portion of each diffuser flow passage may circumferentially flare and curve in a circumferential direction and include compound curved and angled circumferentially spaced apart first and second sides. The first and second sides may flare away from each other. The first and second sides may curve about the linear portion of the diffusing passage centerline and the first and second sides curve in parallel about the curved portion of the diffusing passage centerline.

The diffuser may be incorporated in a high pressure gas generator having a high pressure rotor including, in downstream flow relationship, a high pressure centrifugal compressor, a combustor, and a high pressure turbine drivingly connected to the high pressure centrifugal compressor. The centrifugal compressor includes an annular centrifugal compressor impeller annularly surrounded by the diffuser.

DETAILED DESCRIPTION OF THE INVENTION

Figure 1:
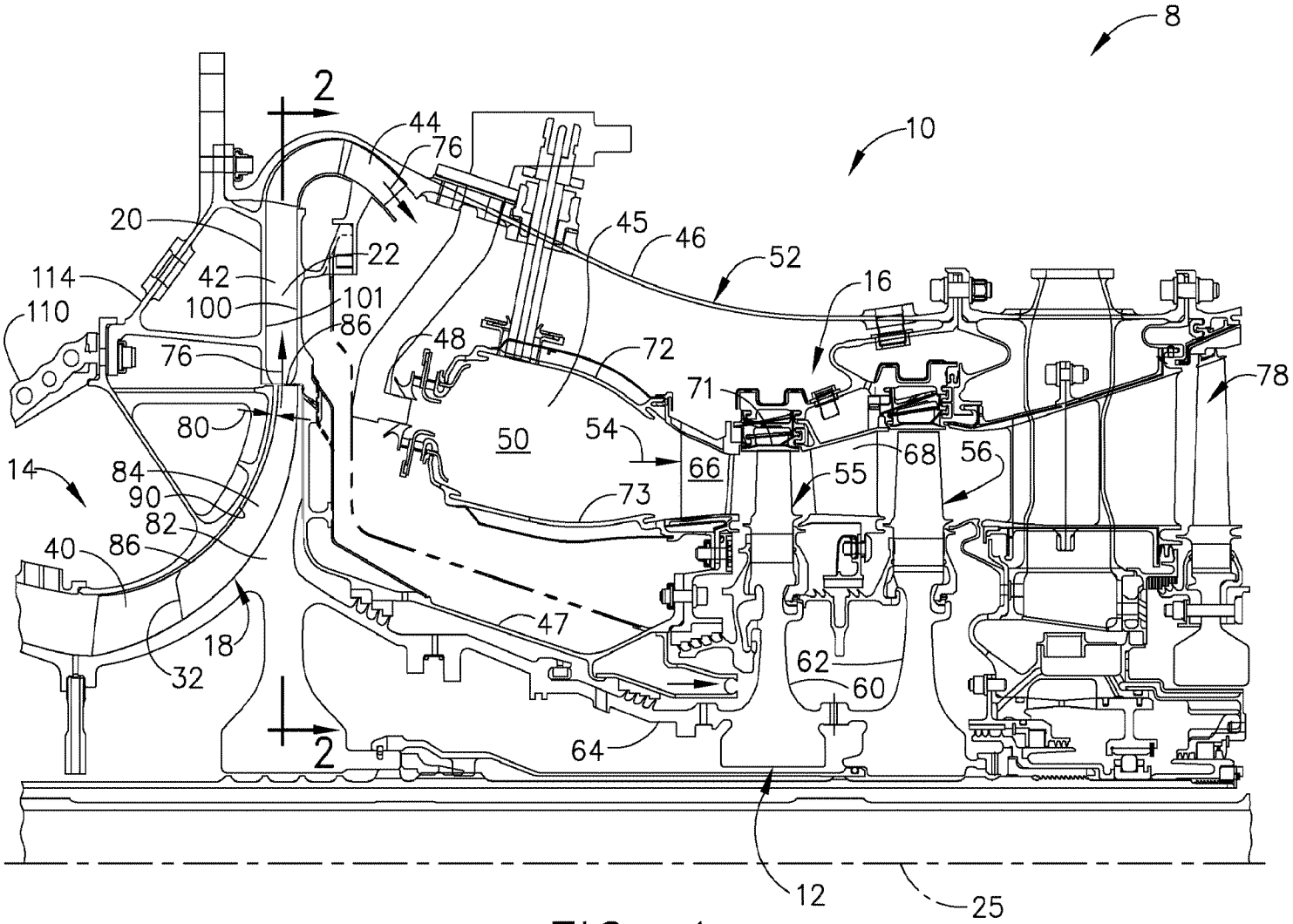
FIG. 1 is a sectional view illustration of a gas turbine engine centrifugal compressor and a diffuser with a diffuser passage having a curved diffuser passage exhaust section.

Illustrated in FIG. 1, gas turbine engine high pressure centrifugal compressor 18 in a high pressure gas generator 10 of a gas turbine engine 8. The high pressure centrifugal compressor 18 is a final compressor stage of a high pressure compressor 14. The high pressure gas generator 10 has a high pressure rotor 12 including, in downstream serial or flow relationship, the high pressure compressor 14, a combustor 52, and a high pressure turbine 16. The rotor 12 is rotatably supported about an engine axis 25 by bearings in engine frames not illustrated herein.

The exemplary embodiment of the high pressure compressor 14 illustrated herein includes a five stage axial compressor 30 followed by the centrifugal compressor 18 having an annular centrifugal compressor impeller 32. Outlet guide vanes 40 are disposed between the five stage axial compressor 30 and the single stage centrifugal compressor 18. Compressor discharge pressure (CDP) air 76 exits the impeller 32 and passes through a diffuser 42 annularly surrounding the impeller 32 and then through a deswirl cascade 44 into a combustion chamber 45 within the combustor 52. The combustion chamber 45 is surrounded by annular radially outer and inner combustor casings 46, 47. Air 76 is conventionally mixed with fuel provided by a plurality of fuel nozzles 48 and ignited and combusted in an annular combustion zone 50 bounded by annular radially outer and inner combustion liners 72, 73.

The combustion produces hot combustion gases 54 which flow through the high pressure turbine 16 causing rotation of the high pressure rotor 12 and continue downstream for further work extraction in a low pressure turbine 78 and final exhaust as is conventionally known. In the exemplary embodiment depicted herein, the high pressure turbine 16 includes, in downstream serial flow relationship, first and second high pressure turbine stages 55, 56 having first and second stage disks 60, 62. A high pressure shaft 64 of the high pressure rotor 12 connects the high pressure turbine 16 in rotational driving engagement to the impeller 32. A first stage nozzle 66 is directly upstream of the first high pressure turbine stage 55 and a second stage nozzle 68 is directly upstream of the second high pressure turbine stage.

Referring to FIG. 1, the compressor discharge pressure (CDP) air 76 is discharged from the impeller 32 of the centrifugal compressor 18 and used to combust fuel in the combustor 52 and to cool components of turbine 16 subjected to the hot combustion gases 54; namely, the first stage nozzle 66, a first stage shroud 71 and the first stage disk 60. The compressor 14 includes a forward casing 110 and an aft casing 114 as more fully illustrated in FIGS. 1 and 2. The forward casing 110 generally surrounds the axial compressor 30 and the aft casing 114 generally surrounds the centrifugal compressor 18 and supports the diffuser 42 directly downstream of the centrifugal compressor 18. The compressor discharge pressure (CDP) air 76 is discharged from the impeller 32 of the centrifugal compressor 18 directly into the diffuser 42.

Figure 2:
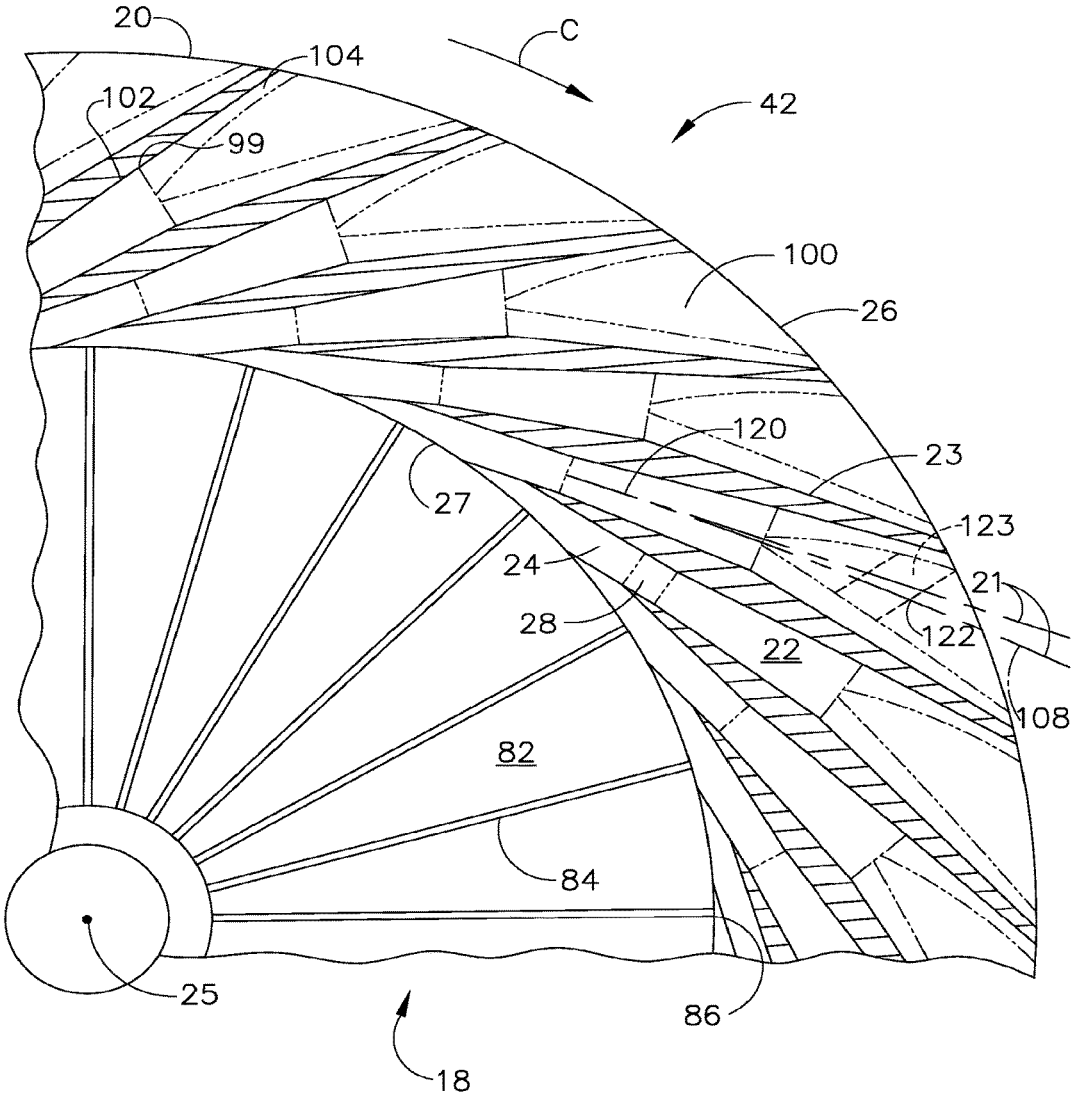
FIG. 2 is a sectional view illustration of the centrifugal compressor and diffuser through 2-2 in FIG. 1.

Referring to FIGS. 1 and 2, the impeller 32 includes a plurality of centrifugal compressor blades 84 radially extending from a rotor disc portion 82. Opposite and axially forward of the compressor blades 84 is an annular blade tip shroud 90. The shroud 90 is adjacent to blade tips 86 of the compressor blades 84 defining a blade tip clearance 80 therebetween. The diffuser 42 disclosed herein is similar to and shares many features with the diffuser disclosed in U.S. Pat. No. 4,576,550.

Figure 3:
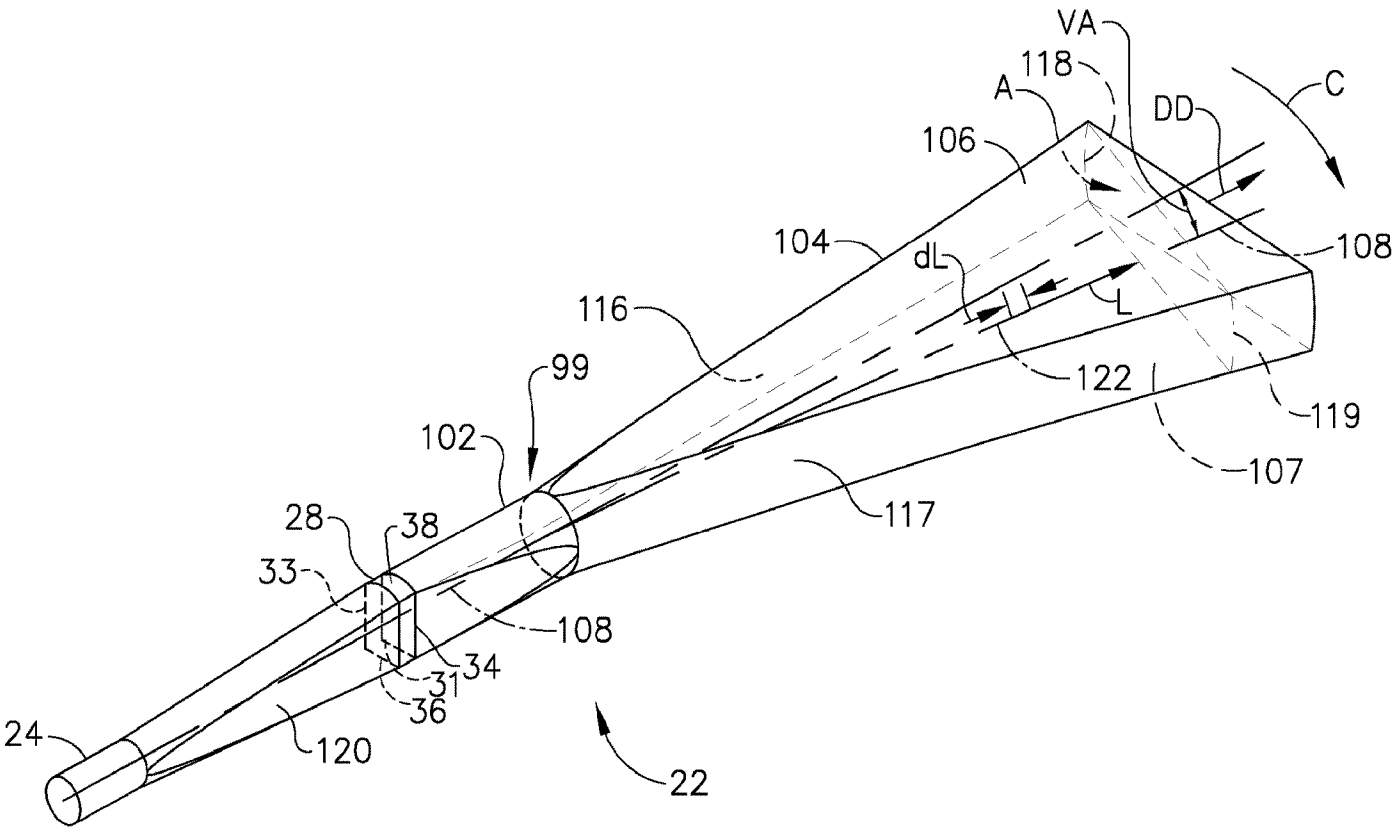
FIG. 3 is a perspective view illustration of the diffuser passage illustrated in FIG. 2.

Referring to FIGS. 1 and 2, the diffuser 42 includes an annular diffuser housing 20 having a plurality of tangentially disposed diffuser flow passages 22 extending radially therethrough. Diffuser vanes 23 axially extend between a forward wall 101 and the aft wall 100 of the diffuser 42. The diffuser vanes 23 circumferentially extend between adjacent ones of the diffuser flow passages 22. Referring to FIGS. 2 and 3, the diffuser flow passages 22 are disposed along centerlines 21 spaced about a circumference 26 of the housing 20. The diffuser flow passages 22 are partly defined and circumferentially bounded by the spaced circumferentially spaced apart diffuser vanes 23. Adjacent ones of the passages 22 intersect with each other at radially inner, inlet portions 24 of the passages 22 that define a quasi-vaneless annular inlet 27 of the diffuser 42. Each passage 22 further includes a throat portion 28 which is downstream of and integral with the inlet portion 24. The throat portion 28 has a first quadrilateral cross section 31, which defines the flow passage thereof and includes two opposing substantially parallel linear sidewalls 33 and 34 and two substantially arcuate opposing sidewalls 36 and 38 (see FIG. 3).

Figure 4:
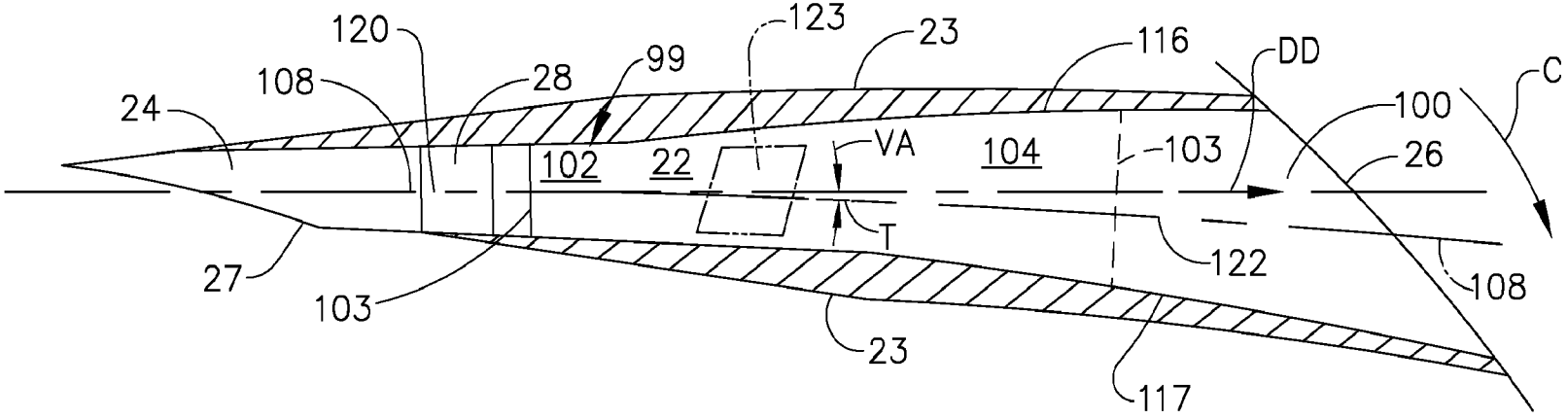
FIG. 4 is a sectional view illustration of the diffuser passage and centerlines illustrated in FIG. 3.

Referring to FIGS. 3 and 4, each passage 22 further includes a diffusing section 99 immediately downstream of the throat portion 28. The diffusing section 99 includes two or more diffusing portions. The exemplary diffuser flow passages 22 illustrated herein has first and second or upstream and downstream diffusing portions 102, 104 immediately downstream of the throat portion 28. The exemplary downstream diffusing portion 104 is curved and has axially spaced apart flat forward facing and aft facing or forward and aft sides 106, 107. The downstream forward and aft sides 106, 107 may be parallel as illustrated herein.

Each passage 22 further includes a diffusing passage centerline 108 equidistantly disposed between the forward and aft walls 101, 100 and adjacent ones of the diffuser vanes 23 in planes 103 normal to the diffusing passage centerline 108. The diffusing passage centerline 108 includes a centerline linear portion 120 extending downstream through the inlet portion 24, the throat portion 28, and the upstream diffusing portion 102 of each of the diffuser flow passages 22. A curved portion 122 of the diffusing passage centerline 108 extends downstream from the centerline linear portion 120 through the curved downstream diffusing portion 104 of each of the diffuser flow passages 22.

The curved portion 122 of the diffusing passage centerline 108 is flat and defines a flat plane 123 normal to the engine axis 25. The inlet portion 24, the throat portion 28, and the upstream diffusing portion 102 of each of the diffuser flow passages 22 are straight. The downstream diffusing portion 104 of each diffuser flow passage 22 is both circumferentially flared and curved in a circumferential direction C. The downstream diffusing portion 104 includes compound curved and angled circumferentially spaced apart first and second sides 116, 117. The first and second sides 116, 117 are flared away from each other and in an embodiment may be linearly flared away from each other in a generally circumferential direction C.

The first and second sides 116, 117 are also curved circumferentially in the same circumferential direction C and amount of degrees (variable angle VA) from the centerline linear portion 120 as is the curved portion 122 of the diffusing passage centerline 108 and, thus, parallel to the curved portion 122. The first and second sides 116, 117 are curved about the linear portion 120 of the diffusing passage centerline 108. In an embodiment, the first and second sides 116, 117 may be circular and, thus, circumscribed about the centerline about the linear portion 120. The circular character of the first and second sides 116, 117 can be seen by circumferentially spaced apart circular first and second edges of a cross-sectional area A normal to the diffusing passage centerline 108 as illustrated in FIG. 3.

Figure 5:
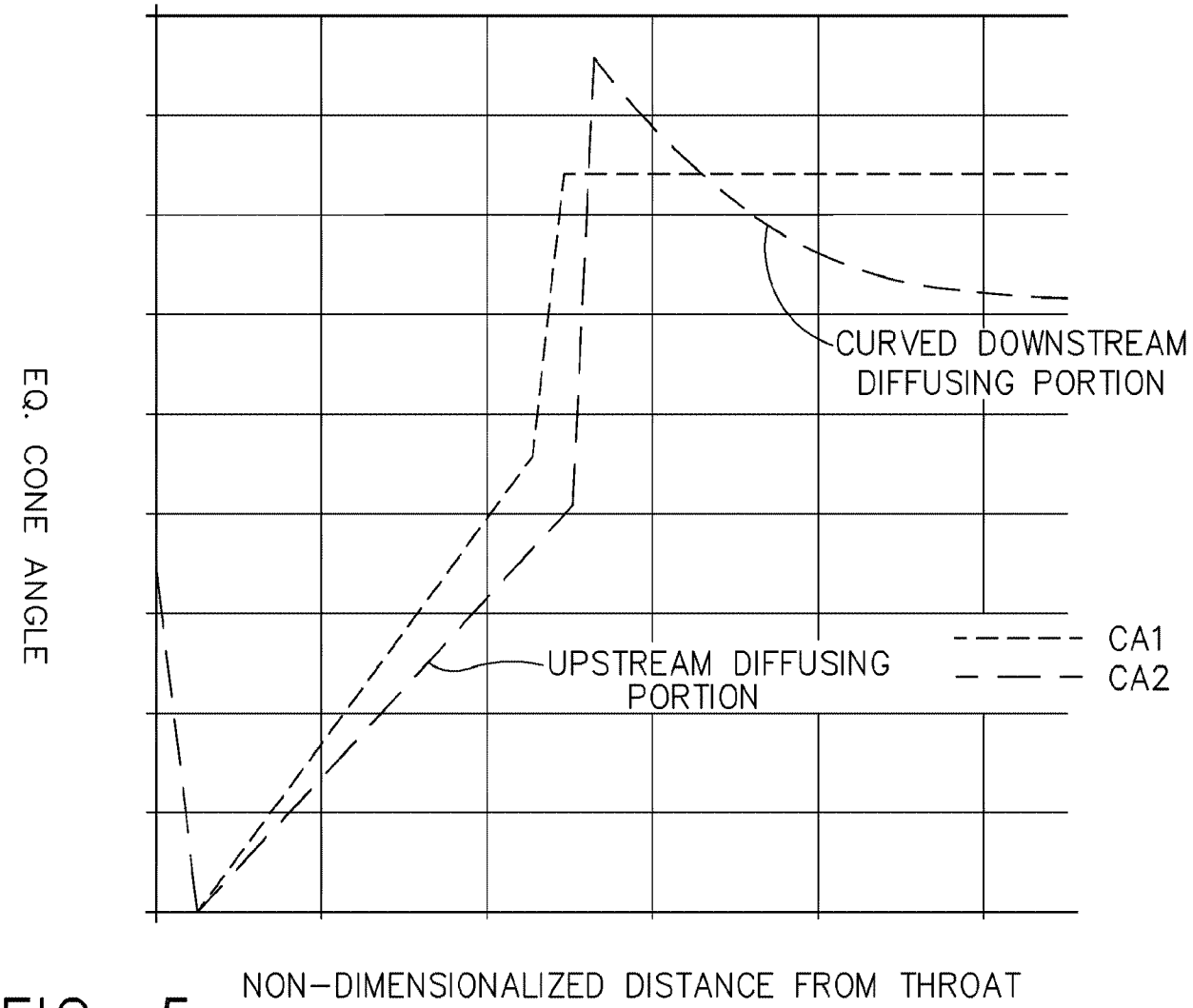
FIG. 5 is a diagrammatical graphic illustration of an exemplary equivalent cone angle (CA1) in the diffuser passage illustrated in FIG. 3 as compared to that of an exemplary diffuser passage with a straight diffuser passage exhaust section.

Referring to FIGS. 3 and 4, a tangent T of the curved portion 122 of the diffusing passage centerline 108 varies with respect to the centerline linear portion 120 by a variable angle VA. The variable angle VA may vary in a range, for example, from 2-10 degrees in a downstream direction DD with respect to the centerline linear portion 120 as illustrated in FIG. 4. Conventional diffusers have completely straight diffuser flow passages and fully linear diffusing passage centerlines. Illustrated in FIG. 5 is an exemplary equivalent cone angle CA1 for an exemplary conventional diffuser with completely straight diffuser flow passages and centerlines compared to an equivalent cone angle CA2 for the diffuser flow passages 22 of the diffuser 42 disclosed herein with the curved portion 122. The equivalent cone angle for centerline linear portions 120 of both diffuser flow passages 22 varies linearly along the diffusing passage centerline 108 where it is linear or straight.

The equivalent cone angle for the curved portion 120 of the diffuser flow passage 22 disclosed herein varies non-linearly and is illustrated as varying curvedly or curvilinearly along the diffusing passage centerline 108. The equivalent cone angle for the curved downstream diffusing portion 104 of the diffuser flow passage 22 disclosed herein may vary curvilinearly as illustrated in FIG. 5 and may be tailored by modifying curves of the curved portion 122 of the diffusing passage centerline 108 and the curved downstream diffusing portion 104 of the diffuser flow passages 22. This allows for increased performance (static pressure rise) and reduced diameter of the diffuser 42.

Equivalent Cone Angle can be calculated as follows:

Dh=sqrt(4*A/2/pi) wherein Dh is Hydraulic Diameter and A is the cross-sectional area of the diffuser flow passage 22 (as illustrated in FIG. 3).

dDh=change in hydraulic diameter from one portion of the diffuser flow passage 22 to the next.

dL=change in length L along the diffusing passage centerline 108 from one portion of the diffuser flow passage 22 to the next (as illustrated in FIG. 3).

$$\text{Equivalent Cone Angle}=\arctan(dDh/dL)$$

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A diffuser for a centrifugal compressor comprising:

an annular diffuser housing, a plurality of diffuser flow passages extending through the housing and spaced about a circumference of the housing, each of the passages including a throat portion and a diffusing section downstream of the throat portion, upstream and downstream diffusing portions of the diffusing section, each of the passages further including a diffusing passage centerline, the diffusing passage centerline including a centerline linear portion extending downstream through the throat portion and the upstream diffusing portion of each of the diffuser flow passages, the diffusing passage centerline including a curved portion of the diffusing passage centerline extending downstream from the centerline linear portion through the downstream diffusing portion, the downstream diffusing portion including compound curved and angled circumferentially spaced apart first and second sides, and the first side flares away from the diffusing passage centerline in a first direction and the second side flares away from the diffusing passage centerline in a second direction away from the first direction.

2. The diffuser according to claim 1 further comprising:

adjacent ones of the passages intersecting with each other at radially inner inlet portions of the passages and defining a quasi-vaneless annular inlet of the diffuser, and each of the passages including the throat portion downstream of and integral with one of the inlet portions, and the centerline linear portion extending downstream through the inlet portion and the throat portion of each of the passages.

3. The diffuser according to claim 1 further comprising each of the diffuser flow passages having an equivalent cone angle varying non-linearly downstream along the curved portion through the downstream diffusing portion of the diffuser flow passage.

4. The diffuser according to claim 1 further comprising each of the diffuser flow passages having an equivalent cone angle varying curvedly or curvilinearly downstream along the curved portion of the diffusing passage centerline through the downstream diffusing portion of the diffuser flow passage.

5. The diffuser according to claim 1 further comprising the downstream diffusing portion of each of the diffuser flow passages including axially spaced apart flat forward facing and aft facing or forward and aft sides.

6. The diffuser according to claim 5 further comprising:

adjacent ones of the passages intersecting with each other at radially inner inlet portions (24) of the passages and defining a quasi-vaneless annular inlet of the diffuser, each of the passages including the throat portion downstream of and integral with one of the inlet portions, and the centerline linear portion extending downstream through the inlet portion and the throat portion of each of the passages.

7. The diffuser according to claim 6 further comprising each of the diffuser flow passages having an equivalent cone angle varying non-linearly downstream along the curved portion of the diffusing passage centerline through the downstream diffusing portion of the diffuser flow passage.

8. The diffuser according to claim 7 further comprising each of the diffuser flow passages having an equivalent cone angle varying curvedly or curvilinearly downstream along the curved portion of the diffusing passage centerline through the downstream diffusing portion of the diffuser flow passage.

9. The diffuser according to claim 8 further comprising:

the downstream diffusing portion of each diffuser flow passage circumferentially flaring and curving in a circumferential direction (C), the first and second sides curving about the linear portion of the diffusing passage centerline and the first and second sides curving in parallel about the curved portion of the diffusing passage centerline.

10. The diffuser according to claim 1 further comprising:

the downstream diffusing portion of each diffuser flow passage circumferentially flaring and curving in a circumferential direction (C).

11. The diffuser according to claim 10 further comprising the first and second sides curving about the linear portion of the diffusing passage centerline and the first and second sides curving in parallel about the curved portion of the diffusing passage centerline.

12. The diffuser according to claim 11 further comprising the downstream diffusing portion of each of the diffuser flow passages including axially spaced apart flat forward facing and aft facing or forward and aft sides.

13. The diffuser according to claim 12 further comprising: adjacent ones of the passages intersecting with each other at radially inner inlet portions of the passages and defining a quasi-vaneless annular inlet of the diffuser, each of the passages including the throat portion downstream of and integral with one of the inlet portions, and the centerline linear portion extending downstream through the inlet portion and the throat portion of each of the passages.

14. The diffuser according to claim 13 further comprising each of the diffuser flow passages having an equivalent cone angle varying non-linearly downstream along the curved portion of the diffusing passage centerline through the downstream diffusing portion of the diffuser flow passage.

15. The diffuser according to claim 14 further comprising each of the diffuser flow passages having an equivalent cone angle varying curvedly or curvilinearly downstream along the curved portion of the diffusing passage centerline through the downstream diffusing portion of the diffuser flow passage.

16. A high pressure gas generator comprising:

a high pressure rotor including, in downstream flow relationship, a high pressure centrifugal compressor, a combustor, and a high pressure turbine drivingly connected to a to the high pressure centrifugal compressor;

the centrifugal compressor including an annular centrifugal compressor impeller;

a diffuser annularly surrounding the impeller;

a plurality of diffuser flow passages extending through a housing of the diffuser and spaced about a circumference of the housing;

each of the passages including a throat portion and a diffusing section downstream of the throat portion;

upstream and downstream diffusing portions of the diffusing section;

each of the passages further including a diffusing passage centerline;

the diffusing passage centerline including a centerline linear portion extending downstream through the throat portion and the upstream diffusing portion of each of the diffuser flow passages;

the diffusing passage centerline including a curved portion of the diffusing passage centerline extending downstream from the centerline linear portion through the downstream diffusing portion, the downstream diffusing portion including compound curved and angled circumferentially spaced apart first and second sides, and the first side flares away from the diffusing passage centerline in a first direction and the second side flares away from the diffusing passage centerline in a second direction away from the first direction.

17. The high pressure gas generator according to claim 16 further comprising:

adjacent ones of the passages intersecting with each other at radially inner inlet portions of the passages and defining a quasi-vaneless annular inlet of the diffuser, and each of the passages including the throat portion downstream of and integral with one of the inlet portions, and the centerline linear portion extending downstream through the inlet portion and the throat portion of each of the passages.

18. The high pressure gas generator according to claim 16 further comprising each of the diffuser flow passages having an equivalent cone angle varying non-linearly downstream along the curved portion of the diffusing passage centerline through the downstream diffusing portion of the diffuser flow passage.

19. The high pressure gas generator according to claim 16 further comprising each of the diffuser flow passages having an equivalent cone angle varying curvedly or curvilinearly downstream along the curved portion of the diffusing passage centerline through the downstream diffusing portion of the diffuser flow passage.

20. The high pressure gas generator according to claim 16 further comprising the downstream diffusing portion of each of the diffuser flow passages including axially spaced apart flat forward facing and aft facing or forward and aft sides.

21. The high pressure gas generator according to claim 20 further comprising:

adjacent ones of the passages intersecting with each other at radially inner inlet portions of the passages and defining a quasi-vaneless annular inlet of the diffuser, and each of the passages including the throat portion downstream of and integral with one of the inlet portions, and the centerline linear portion extending downstream through the inlet portion and the throat portion of each of the passages.

22. The high pressure gas generator according to claim 16 further comprising:

the downstream diffusing portion of each diffuser flow passage circumferentially flaring and curving in a circumferential direction (C).

23. The high pressure gas generator according to claim 22 further comprising the first and second sides curving about the linear portion of the diffusing passage centerline and the first and second sides curving in parallel about the curved portion of the diffusing passage centerline.

24. The high pressure gas generator according to claim 23 further comprising the first and second sides curving about the linear portion of the diffusing passage centerline and the first and second sides curving in parallel about the curved portion of the diffusing passage centerline.

* * * * *